US010148025B1

(12) United States Patent
Trout et al.

(10) Patent No.: US 10,148,025 B1
(45) Date of Patent: Dec. 4, 2018

(54) HEADER CONNECTOR OF A COMMUNICATION SYSTEM

(71) Applicant: TE CONNECTIVITY CORPORATION, Berwyn, PA (US)

(72) Inventors: David Allison Trout, Lancaster, PA (US); Justin Dennis Pickel, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/867,955

(22) Filed: Jan. 11, 2018

(51) Int. Cl.

| | |
|---|---|
| ***H01R 13/6471*** | (2011.01) |
| ***H01R 13/6582*** | (2011.01) |
| ***H01R 12/58*** | (2011.01) |
| ***H01R 13/6587*** | (2011.01) |
| *H01R 12/72* | (2011.01) |

(52) U.S. Cl.
CPC ..... *H01R 12/585* (2013.01); *H01R 13/6471* (2013.01); *H01R 13/6587* (2013.01); *H01R 12/722* (2013.01); *H01R 13/6582* (2013.01)

(58) Field of Classification Search
CPC ..... H01R 13/6471; H01R 13/6585; H01R 12/722; H01R 13/6582
See application file for complete search history.

(56) References Cited

U.S. PATENT DOCUMENTS

| | | | | |
|---|---|---|---|---|
| 6,572,410 | B1 * | 6/2003 | Volstorf | H01R 13/6585 439/108 |
| 7,094,102 | B2 * | 8/2006 | Cohen | H01R 13/6587 439/607.08 |
| 8,382,522 | B2 | 2/2013 | Glover et al. | |
| 9,425,556 | B1 | 8/2016 | Pickel | |
| 9,831,608 | B1 | 11/2017 | Pickel et al. | |
| 2003/0143894 | A1 * | 7/2003 | Kline | H01R 13/518 439/607.56 |
| 2011/0263141 | A1 | 10/2011 | Ko | |
| 2014/0024256 | A1 * | 1/2014 | Davis | H01R 13/6587 439/607.05 |
| 2014/0194004 | A1 * | 7/2014 | Pickel | H01R 13/6587 439/607.01 |
| 2014/0242841 | A1 * | 8/2014 | Trout | H01R 13/6587 439/607.55 |
| 2017/0005445 | A1 * | 1/2017 | Resendez | H01R 13/6585 |

* cited by examiner

*Primary Examiner* — Briggitte R Hammond

(57) ABSTRACT

A header connector includes a header housing having a base and a cavity with header signal contacts coupled to the base and header ground contacts coupled to the base having a mating end extending into the cavity providing electrical shielding for corresponding contact pairs of the header signal contacts. Each header ground contact includes an end wall and a side wall extending from the end wall. Ground contact shield elements are coupled to corresponding header ground contacts along the corresponding side walls of the header ground contacts. The ground contact shield elements are deflectable and spring biased to extend toward the nearest header signal contact of the corresponding contact pair such that the ground contact shield element is positioned closer to the header signal contact than the side wall of the corresponding header ground contact.

26 Claims, 6 Drawing Sheets

HEADER CONNECTOR OF A COMMUNICATION SYSTEM

BACKGROUND OF THE INVENTION

The subject matter herein relates generally to header connectors of a communication system.

Communication systems use electrical connectors to transmit data and/or power in various industries. For example, in high speed backplane systems, header and receptacle connectors are provided to interconnect various components of the communication system, such as circuit boards of the communication system. The header and receptacle connectors have corresponding contacts that are mated. The receptacle and header connectors are designed for system tolerances, such as to accommodate for situations when the header and receptacle connectors are not fully mated. For example, the receptacle and header connectors may be designed to having a mating range of approximately 1.5 mm. When the receptacle connector is de-mated, such as up to the 1.5 mm de-mated position, the signal lines may suffer from signal degradation and have reduced performance. For example, air may surround the signal contacts at the mating interface when only partially mated, affecting impedance and signal integrity of the signal lines.

A need remains for electrical connectors that reduce signal degradation when the electrical connectors are not fully mated.

BRIEF DESCRIPTION OF THE INVENTION

In an embodiment, a header connector is provided including a header housing configured to engage a receptacle connector having a base and a cavity forward of the base. Header signal contacts are coupled to the base having a mating end extending into the cavity configured to be electrically connected to a corresponding receptacle signal contact and being arranged in contact pairs. Header ground contacts are coupled to the base having a mating end extending into the cavity and providing electrical shielding for corresponding contact pairs of the header signal contacts. Each header ground contact includes an end wall and a side wall extending from the end wall. Ground contact shield elements are coupled to corresponding header ground contacts along the corresponding side walls of the header ground contacts. The ground contact shield elements are deflectable and spring biased to extend toward the nearest header signal contact of the corresponding contact pair such that the ground contact shield element is positioned closer to the header signal contact than the side wall of the corresponding header ground contact.

In a further embodiment, a communication system is provided including a receptacle connector and a header connector. The receptacle connector includes a receptacle housing having a mating end and receptacle signal contacts and receptacle ground contacts held in the receptacle housing. The header connector includes a header housing having a base and a cavity forward of the base receiving the mating end of the receptacle housing. Header signal contacts are coupled to the base having a mating end extending into the cavity configured to be electrically connected to a corresponding receptacle signal contact and being arranged in contact pairs. Header ground contacts are coupled to the base having a mating end extending into the cavity and providing electrical shielding for corresponding contact pairs of the header signal contacts. Each header ground contact includes an end wall and a side wall extending from the end wall. Ground contact shield elements are coupled to corresponding header ground contacts along the corresponding side walls of the header ground contacts. The ground contact shield elements are deflectable and spring biased to extend toward the nearest header signal contact of the corresponding contact pair such that the ground contact shield element is positioned closer to the header signal contact than the side wall of the corresponding header ground contact.

DETAILED DESCRIPTION OF THE INVENTION

Embodiments set forth herein may include header ground shield elements for header ground contacts of header connectors. Embodiments may be configured to reduce signal degradation between electrical connectors compared to other known systems. Although the illustrated embodiment includes electrical connectors that are used in high-speed communication systems, such as backplane or midplane communication systems, it should be understood that embodiments may be used in other communication systems or in other systems/devices that utilize electrical connectors. Accordingly, the inventive subject matter is not limited to the illustrated embodiment.

Figure 1:
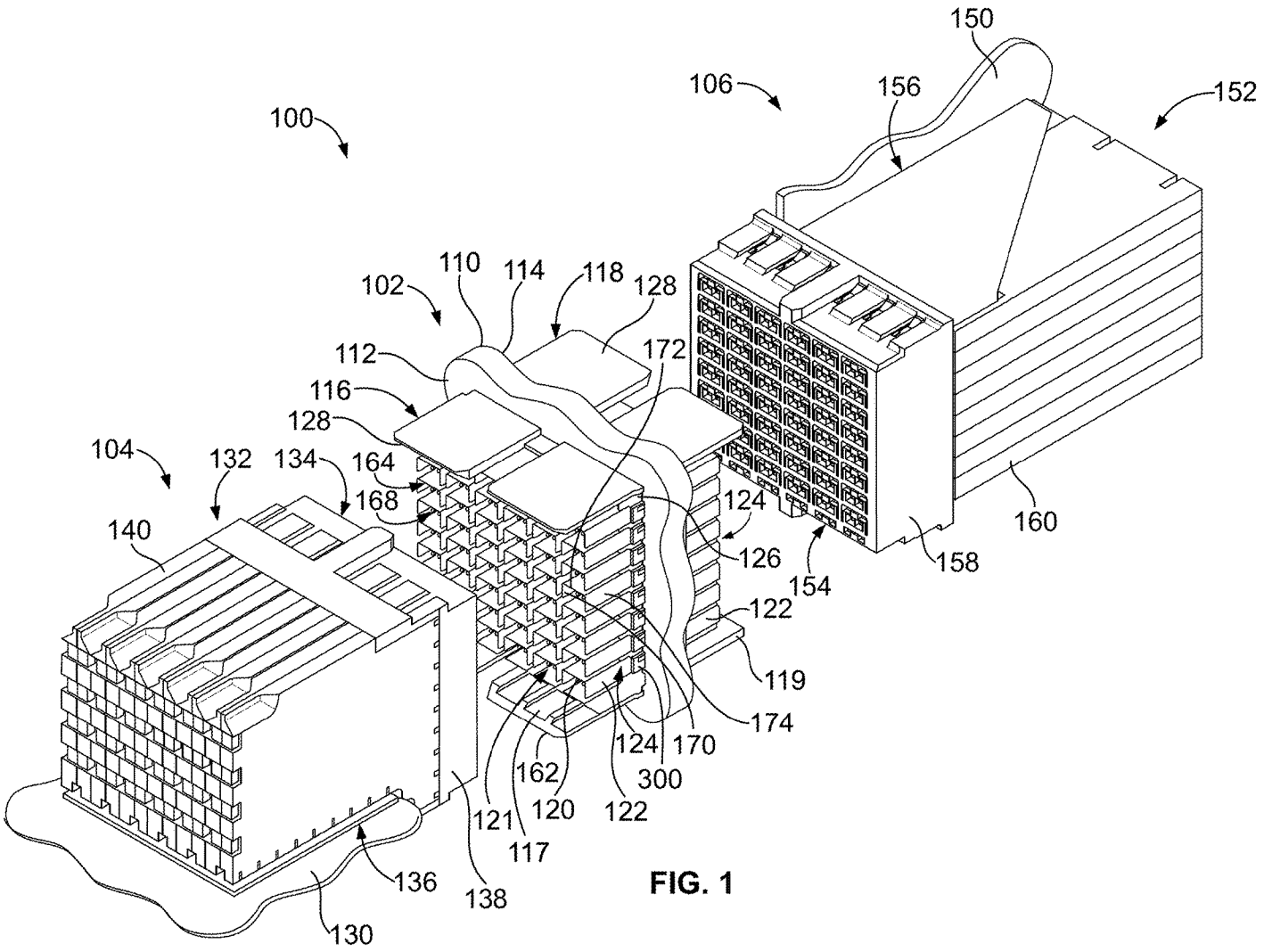
FIG. 1 is a perspective view of a communication system including header connectors and receptacle connectors formed in accordance with an embodiment.

FIG. 1 is a perspective view of a communication system 100 formed in accordance with an embodiment. In particular embodiments, the communication system 100 may be a backplane or midplane communication system. The communication system 100 includes a circuit board assembly 102, a first connector system (or assembly) 104 configured to be coupled to one side of the circuit board assembly 102, and a second connector system (or assembly) 106 configured to be coupled to an opposite side of the circuit board assembly 102. The circuit board assembly 102 is used to electrically connect the first and second connector systems 104, 106. Optionally, the first and second connector systems 104, 106 may be line cards or switch cards. Although the communication system 100 is configured to interconnect two connector systems in the illustrated embodiment, other communication systems may interconnect more than two connector systems or, alternatively, interconnect a single connector system to another communication device.

The circuit board assembly 102 includes a circuit board 110 having a first board side 112 and second board side 114. In some embodiments, the circuit board 110 may be a backplane circuit board, a midplane circuit board, or a motherboard. In the illustrated embodiment, the circuit board assembly 102 includes a first header connector 116 mounted to and extending from the first board side 112 of the circuit board 110. The circuit board assembly 102 also includes a second header connector 118 mounted to and extending from the second board side 114 of the circuit board 110. In alternative embodiments, the circuit board assembly 102 may include only a single header connector 116 or may include multiple header connectors 116 on the same side of the circuit board 110.

The first and second header connectors 116, 118 include header housings 117, 119, respectively. The first and second header connectors 116, 118 also include corresponding header signal contacts 120. The header signal contacts 120 may be pin contacts. The circuit board assembly 102 includes a plurality of signal paths therethrough defined by the header signal contacts 120 and conductive vias that extend through the circuit board 110.

The first and second header connectors 116, 118 include ground contact assemblies 124 that provide electrical shielding around corresponding header signal contacts 120. The ground contact assemblies 124 include header ground contacts 122 and ground contact shield elements 300 coupled to the header ground contacts 122. In an exemplary embodiment, the header signal contacts 120 are arranged in contact pairs 121 and are configured to convey differential signals. Each of the header ground contacts 122 may peripherally surround a corresponding contact pair 121. As shown, the header ground contacts 122 are C-shaped or U-shaped and cover the corresponding contact pair 121 along three sides. The header ground contacts 122 may have other shapes in alternative embodiments, such as L-shaped, I-shaped, beams, and the like.

The header housing 117, 119 may be manufactured from a dielectric material, such as a plastic material. Each of the header housings 117, 119 includes a base 126 that is configured to be mounted to the circuit board 110 and shroud walls 128 that extend from the base 126. The shroud walls 128 form a cavity 164. The header signal contacts 120 and the header ground contacts 122 extend into the cavity 164. The receptacle connectors are configured to be received in the cavity 164. The shroud walls 128 cover portions of the header signal contacts 120 and the header ground contacts 122. The header housings 117, 119 hold the header signal contacts 120 and the header ground contacts 122 in designated positions relative to each other.

The first connector system 104 includes a first circuit board 130 and a first receptacle connector 132 that is mounted to the first circuit board 130. The first receptacle connector 132 is configured to be coupled to the first header connector 116 of the circuit board assembly 102 during a mating operation. The first receptacle connector 132 has a mating interface 134 that is configured to be mated with the first header connector 116. The first receptacle connector 132 has a board interface 136 configured to be mated with the first circuit board 130. In an exemplary embodiment, the board interface 136 is orientated perpendicular to the mating interface 134. When the first receptacle connector 132 is coupled to the first header connector 116, the first circuit board 130 is orientated perpendicular to the circuit board 110.

The first receptacle connector 132 includes a receptacle housing 138. The receptacle housing 138 is configured to hold a plurality of contact modules 140 side-by-side. As shown, the contact modules 140 are held in a stacked configuration generally parallel to one another. In some embodiments, the contact modules 140 hold a plurality of receptacle signal contacts 142 (shown in FIG. 2) that are electrically connected to the first circuit board 130. The receptacle signal contacts 142 are configured to be electrically connected to the header signal contacts 120 of the first header connector 116. In an exemplary embodiment, the receptacle signal contacts 142 are socket contacts defining sockets that receive corresponding pin contacts defined by the header signal contacts 120.

The second connector system 106 includes a second circuit board 150 and a second receptacle connector 152 coupled to the second circuit board 150. The second receptacle connector 152 is configured to be coupled to the second header connector 118 during a mating operation. The second receptacle connector 152 has a mating interface 154 configured to be mated with the second header connector 118. The second receptacle connector 152 has a board interface 156 configured to be mated with the second circuit board 150. In an exemplary embodiment, the board interface 156 is orientated perpendicular to the mating interface 154. When the second receptacle connector 152 is coupled to the second header connector 118, the second circuit board 150 is orientated perpendicular to the circuit board 110.

Similar to the first receptacle connector 132, the second receptacle connector 152 includes a receptacle housing 158 used to hold a plurality of contact modules 160. The contact modules 160 are held in a stacked configuration generally parallel to one another. The contact modules 160 hold a plurality of receptacle signal contacts (not shown) that are electrically connected to the second circuit board 150. The receptacle signal contacts are configured to be electrically connected to the header signal contacts 120 of the second header connector 118. The receptacle signal contacts of the contact modules 160 may be similar or identical to the receptacle signal contacts 142.

In the illustrated embodiment, the first circuit board 130 is oriented generally horizontally. The contact modules 140 of the first receptacle connector 132 are orientated generally vertically. The second circuit board 150 is oriented generally vertically. The contact modules 160 of the second receptacle connector 152 are oriented generally horizontally. As such, the first connector system 104 and the second connector system 106 have an orthogonal orientation with respect to one another.

In alternative embodiments, rather than using the midplane circuit board assembly 102 between the two connector systems 104, 106, the connector systems 104, 106 may be directly mated together. One of the connector systems 104 may define a receptacle connector system while the other connector system 106 may define a header connector system. The receptacle connector system may be identical to the connector system 104 shown in FIG. 1, while the header connector system may include the contact modules 160, but have header contacts or pin contacts at the mating interface 154 with mating ends similar to the header signal contacts 120.

The header connectors 116, 118 may be similar or identical. The header housing 117 includes a front end 162 that faces away from the first board side 112 of the circuit board 110. The header housing 117 defines a housing cavity 164 that opens to the front end 162 and is configured to receive the first receptacle connector 132 when the first receptacle connector 132 is advanced into the housing cavity 164. The header connector 116 includes a contact array 168 that includes the header signal contacts 120 and the header ground contacts 122. The contact array 168 may include multiple contact pairs 121. The header ground contacts 122 provide electrical shielding for the header signal contacts 120. In an exemplary embodiment, the ground contact assemblies 124 include the ground contact shield elements 300 electrically coupled to the header ground contacts 122. The ground contact shield elements 300 extend from the header ground contacts 122 toward the corresponding header signal contacts 120. In an exemplary embodiment, the ground contact shield elements 300 are deflectable and are configured to be extended toward the header signal contacts 120 and flex or deflect away from the header signal contacts 120 to control spacing of conductive material in the vicinity of the header signal contacts 120 for impedance control. For example, when the ground contact shield elements 300 are extended toward the header signal contacts 120, the impedance may be increased. In contrast, when the ground contact shield elements 300 are flexed away from the header signal contacts 120, the impedance may be decreased. The ground contact shield elements 300 are used for impedance control when mating and on mating the receptacle connector 132 and the header connector 116.

The header ground contacts 122 are C-shaped and provide shielding on three sides of the contact pair 121. The header ground contacts 122 have a plurality of walls, such as three planar walls 170, 172, 174 that define a shield pocket 176. The shield pocket 176 receives one or more of the header signal contacts 120. The planar walls 170, 172, 174 may be integrally formed or alternatively, may be separate pieces. In an exemplary embodiment, compliant pins may extend from each of the planar walls 170, 172, 174 for reception into conductive vias of the circuit board 110 to electrically connect the planar walls 170, 172, 174 to the circuit board 110. The planar wall 172 defines an end wall or top wall of the header ground contact 122 and may be referred to hereinafter as an end wall 172. The planar walls 170, 174 define side walls that extend from the planar wall 172 and may be referred to hereinafter as side walls 170, 174. The side walls 170, 174 may be generally perpendicular to the end wall 172. Other configurations or shapes for the header ground contacts 122 are possible in alternative embodiments. For example, more or fewer walls may be provided in alternative embodiments. The walls may be bent or angled rather than being planar. In other embodiments, the header ground contacts 122 may provide shielding for individual header signal contacts 120 or sets of contacts having more than two header signal contacts 120.

Figure 2:
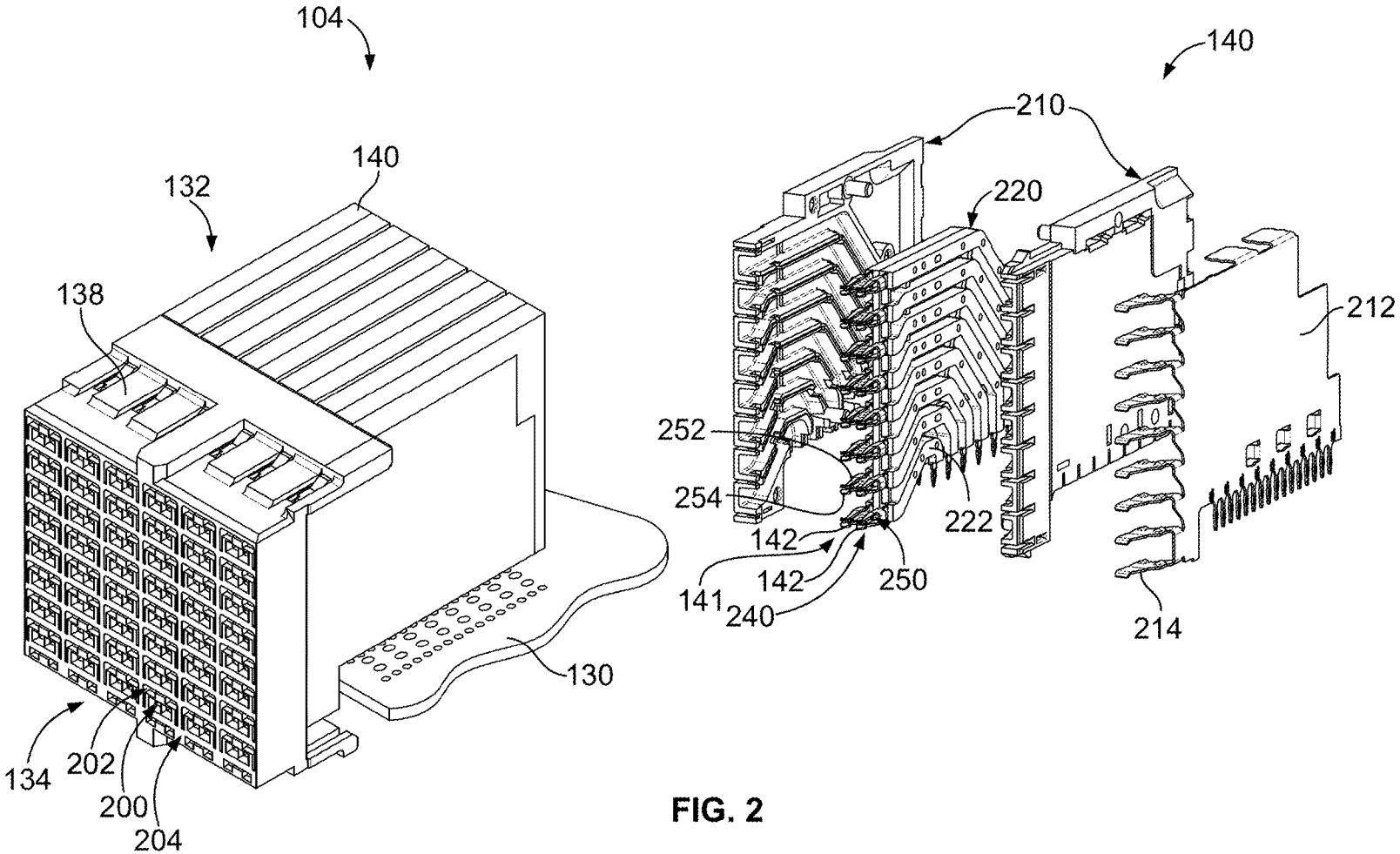
FIG. 2 is a partially exploded view of a receptacle connector of the communication system.

FIG. 2 is a partially exploded view of the first connector system 104 including the first receptacle connector 132. Although the following description is with respect to the first receptacle connector 132, the description may be similarly applied to the second receptacle connector 152 (FIG. 1). FIG. 2 illustrates one of the contact modules 140 in an exploded state. The receptacle housing 138 includes a plurality of contact channels 200, 202 at a front or mating end 204 of the receptacle housing 138. The mating end 204 defines the mating interface 134 of the first receptacle connector 132 that engages the first header connector 116 (FIG. 1).

The contact modules 140 are coupled to the receptacle housing 138 such that the receptacle signal contacts 142 are received in corresponding contact channels 200. Optionally, a single receptacle signal contact 142 may be received in each contact channel 200. The contact channels 200 are configured to receive corresponding header signal contacts 120 (FIG. 1) through the mating end 204 when the receptacle and header connectors 132, 116 are mated. The contact channels 202 receive corresponding header ground contacts 122 (FIG. 1) therein when the receptacle and header connectors 132, 116 are mated.

In some embodiments, the contact module 140 includes a conductive holder 210 fabricated from a conductive material to provide electrical shielding for the first receptacle connector 132. The conductive holder 210 is configured to support a frame assembly 220 that includes a plurality of the receptacle signal contacts 142. The frame assembly 220 may include a dielectric frame 222 supporting the receptacle signal contacts 142. The dielectric frame 222 may be an overmolded frame overmolded around the receptacle signal contacts 142. For example, the receptacle signal contacts 142 may be stamped and formed from a leadframe that is overmolded by the dielectric frame 222. The receptacle signal contacts 142 include mating ends 240 that extend from the frame assembly 220. The mating ends 240 are configured to be mated with corresponding header signal contacts 120. Optionally, the receptacle signal contacts 142 are arranged as signal pairs 141.

In an exemplary embodiment, the contact module 140 includes one or more ground shields 212 providing electrical shielding for the receptacle signal contacts 142. The ground shields 212 have receptacle ground contacts 214 configured to be electrically connected to corresponding header ground contacts 122. In the illustrated embodiment, the contact module 140 includes a single ground shield 212 coupled to one side of the conductive holder 210. The ground shield 212 is electrically connected to the conductive holder 210. In alternative embodiments, the contact module 140 may include a pair of ground shields 212 on each side of the conductive holder 210. In other alternative embodiments, the contact module 140 may be provided without the conductive holder 210, rather utilizing the ground shield 212 to provide electrical shielding. In other alternative embodiments, the ground contacts 214 may be part of the leadframe forming the receptacle signal contacts 142.

In an exemplary embodiment, the receptacle signal contacts 142 may be stamped from a sheet of material and be shaped to include socket 250. For example, each receptacle signal contact 142 may include a pair of elongated, flexible contact fingers 252, 254 forming the socket 250 that receives the header signal contact 120.

Figure 3:
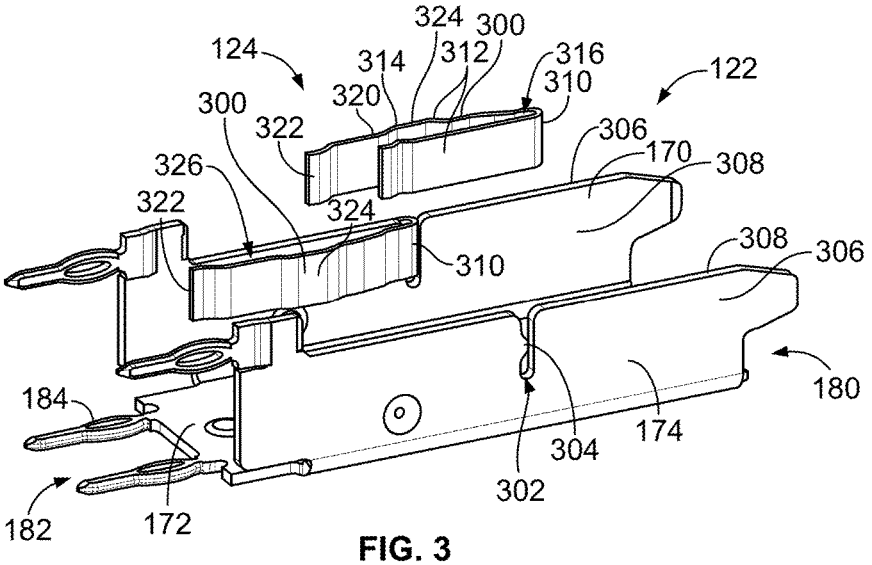
FIG. 3 is a perspective view of a header ground contact and a ground contact shield element of a ground contact assembly in accordance with an exemplary embodiment.
Figure 4:
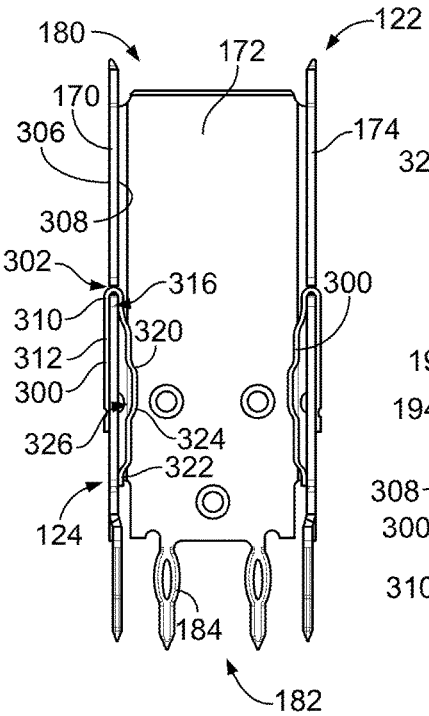
FIG. 4 is an end view of the header ground contact and the ground contact shield element in accordance with an exemplary embodiment.

FIG. 3 is a perspective view of the ground contact assembly 124 including the header ground contact 122 and the ground contact shield elements 300 in accordance with an exemplary embodiment. FIG. 4 is an end view of the ground contact assembly 124 including the header ground contact 122 and the ground contact shield elements 300 in accordance with an exemplary embodiment. In the illustrated embodiment, a pair of the ground contacts shield elements 300 are provided configured to be coupled to corresponding side walls 170, 174 of the header ground contact 122. In FIG. 3, one of the ground contacts shield elements 300 is illustrated coupled to the side wall 170, while the other ground contact shield elements 300 is poised for coupling to the side wall 174. However, in alternative embodiments, only one of the side walls 170, 174 may have a corresponding ground shield element 300 or the ground shield element 300 may be coupled to the end wall 172.

The header ground contact 122 extends between a mating end 180 and a mounting end 182. The mating end 180 is configured to extend into the cavity 164 of the header housing 117 (shown in FIG. 1) for mating with the receptacle connector 132 (shown in FIG. 1). The mounting end 182 is configured to extend from the header housing 117 for termination to the circuit board 110 (shown in FIG. 1). In the illustrated embodiment, the header ground contact 122 includes compliant pins 184, such as eye-of-the-needle pins, configured to be mounted to the circuit board 110. Other types of mounting features may be provided in alternative embodiments. The lower portion of the header ground contact 122 proximate to the mounting end 182 is configured to pass through the base 126 (shown in FIG. 1) of the header housing 117. The upper portion of the header ground contact 122 proximate to the mating end 180 is configured to extend from the base 126 into the cavity 164.

In the illustrated embodiment, the header ground contact 122 is C-shaped having the end wall 172 and the side walls 170, 174 extending from the end wall 172. In an exemplary embodiment, the ground contact shield elements 300 are coupled to the side walls 170, 174. In an exemplary embodiment, the ground contact shield elements 300 may be clipped onto the side walls 170, 174. However, the ground contact shield elements 300 may be secured to the side walls 170, 174 by other means in alternative embodiments, such as by welding to the side walls 170, 174. In an exemplary embodiment, each side wall 170, 174 includes a slot 302 extending therethrough. A retention bump 304 extends into the slot 302 to engage and hold the ground contacts shield elements 300 and the slot 302. Optionally, the ground contact shield elements 300 may be secured to the header ground contact 122 by an interference fit, such as using the retention bump 304. In an exemplary embodiment, the ground contact shield element 300 extends along an exterior surface 306 of the header ground contact 122 and along an interior surface 308 of the header ground contact 122 into the shield pocket 176.

In an exemplary embodiment, the ground contact shield element 300 includes a base 310 configured to be secured to the header ground contact 122. The ground contact shield element 300 includes a base arm 312 extending along the exterior surface 306. The base arm 312 includes a protrusion 314 proximate to a distal end of the base arm 312 configured to engage the exterior surface 306 of the header ground contact 122. The protrusion 314 defines a point of contact with the header ground shield 122. In an exemplary embodiment, the base 310 of the contact shield element 300 forms a pocket 316 by wrapping around opposite sides of the sidewalls 170, 174. The base 310 is configured to be received in the slot 302 and engage the retention bump 304. The retention bump 304 defines a point of contact between the base 310 and the header ground contact 122. The base 310 wraps around the header ground contact 122 from the exterior surface 306 to the interior surface 308.

Figure 8:
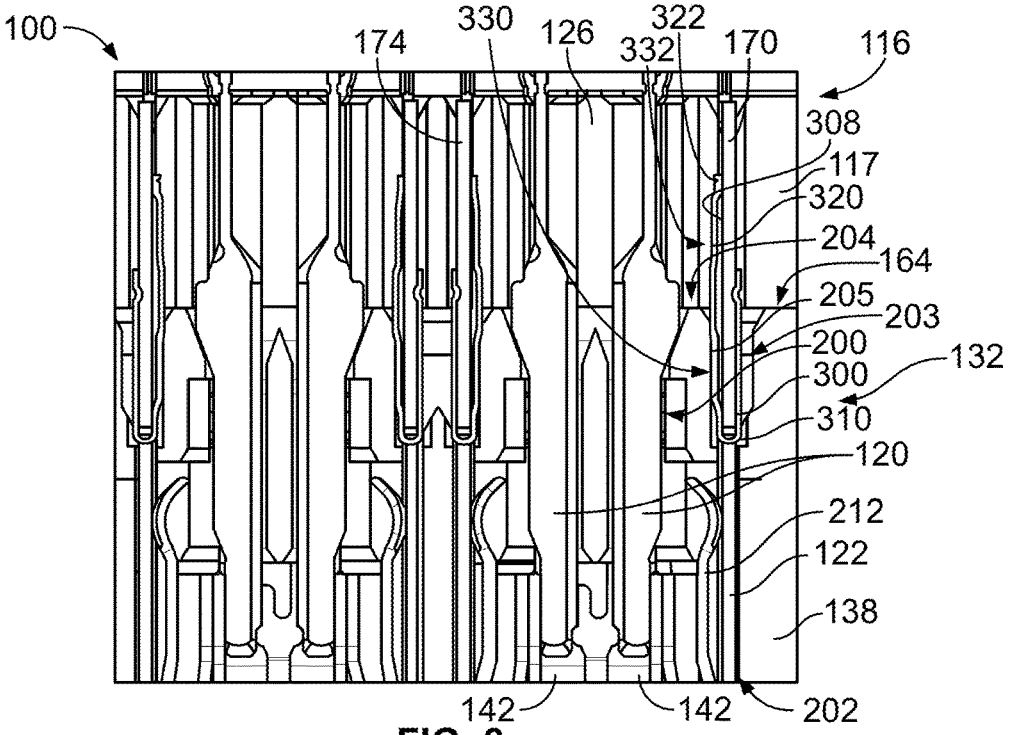
FIG. 8 is a cross-sectional view of a portion of the communication system showing a portion of the header connector fully mated with a portion of the receptacle connector.

In an exemplary embodiment, the ground contact shield element 300 includes a spring beam 320 extending from the base 310. The spring beam 320 extends to a distal end 322. In an exemplary embodiment, the spring beam 320 is deflectable and may be flexed relative to the header ground contact 122. For example, the spring beam 320 may be deflectable between an extended position (FIG. 3) and a flexed position (FIG. 8). The spring beam 320 is deflected closer to the side wall 170, 174 and the flexed position. The spring beam 320 extends further into the space between the side walls 170, 174, and thus closer to the header signal contacts 120, in the extended position. The spring beam 320 is movable toward and away from the side wall 170, 174.

In an exemplary embodiment, the distal end 322 engages the interior surface 308 of the side wall 170, 174 to define a point of contact with the header ground contact 122. As such, the ground contact shield element 300 has multiple points of contact with the header ground contact 122. Providing a point of contact proximate to the front end of the ground contact shield element 300 and proximate to the rear end of the ground contact shield element 300 prevents an electrical stub along the ground path.

A flexed section 324 of the spring beam 320 between the distal end 322 and the base 310 is configured to be flexed away from the interior surface 308 of the header ground contact 122 such that a space 326 is formed between the flexed section 324 and the interior surface 308. The space 326 may be at least partially and in some cases fully closed when the flexed section 324 is deflected to the flexed position. For example, the flexed section 324 may be moved closer to and may engage the interior surface 308 in the flexed position.

Figure 5:
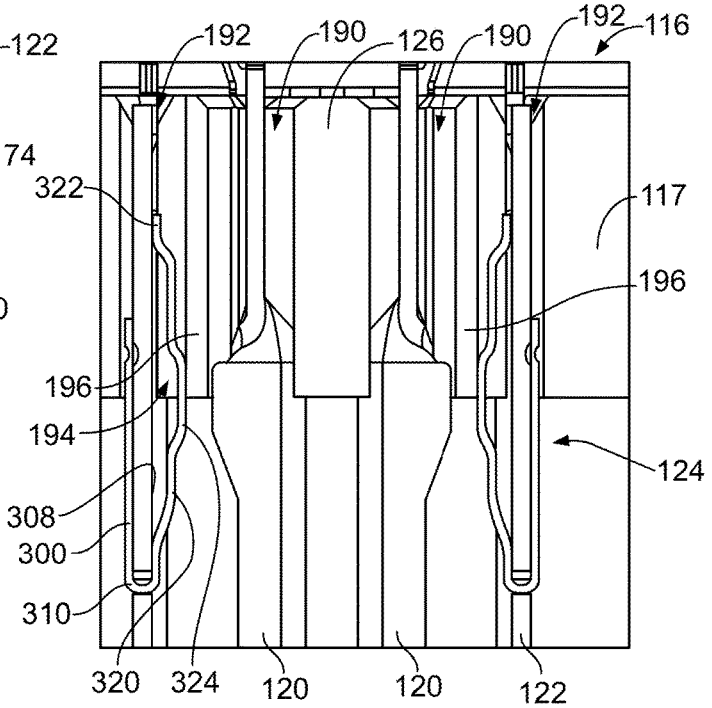
FIG. 5 is a cross-sectional view of a portion of the header connector showing header signal contacts and a header ground contact with the ground contact shield elements in accordance with an exemplary embodiment.
Figure 6:
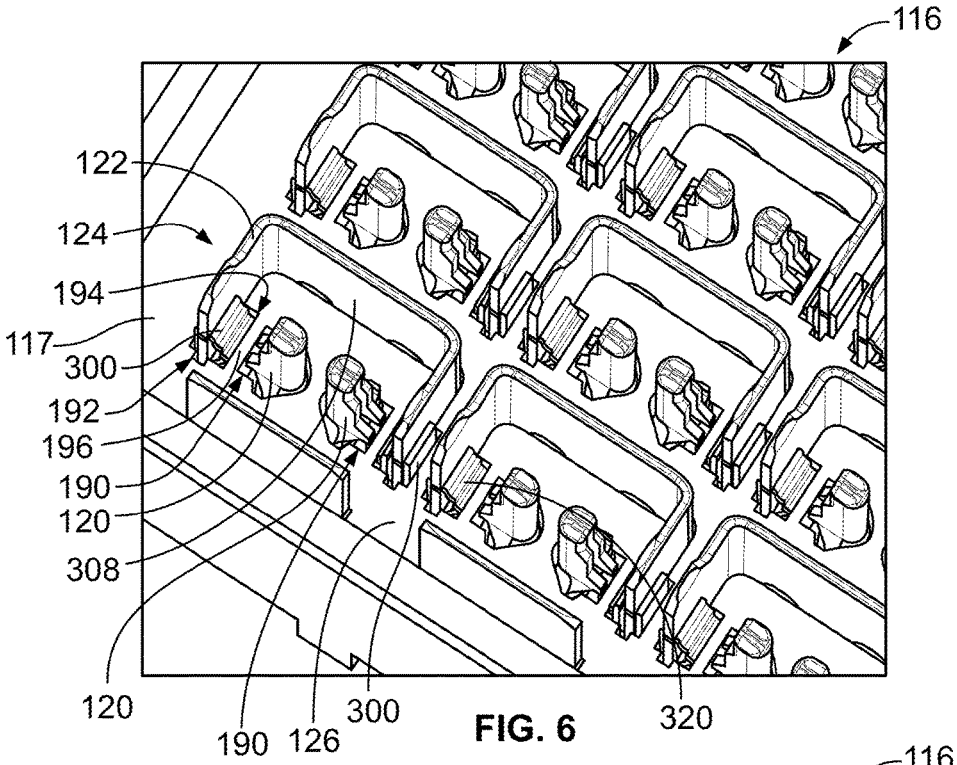
FIG. 6 is a perspective view of a portion of the header connector in accordance with an exemplary embodiment.
Figure 7:
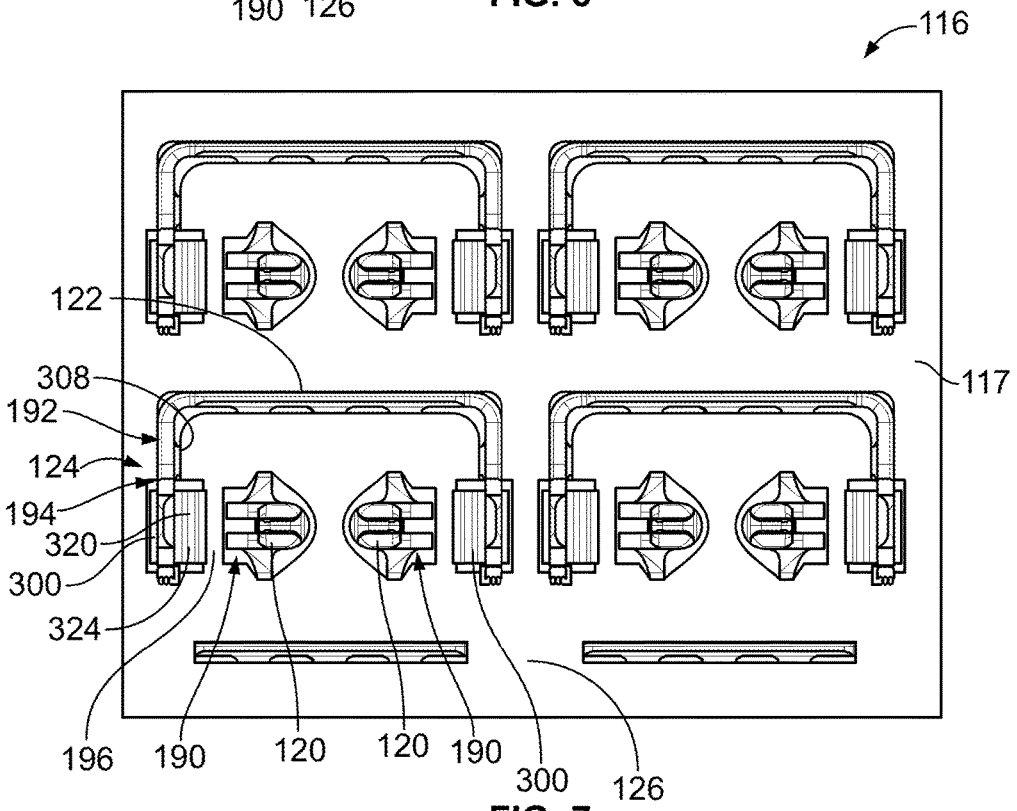
FIG. 7 is a front view of the header connector in accordance with an exemplary embodiment.

FIG. 5 is a cross-sectional view of a portion of the header connector 116 showing a pair of the header signal contacts 120 and the corresponding ground contact assembly 124 including the header ground contact 122 with the ground contact shield elements 300 mounted thereto. FIG. 6 is a perspective view of a portion of the header connector 116 in accordance with an exemplary embodiment. FIG. 7 is a front view of the header connector 116 in accordance with an exemplary embodiment. The header housing 117 holds the header signal contacts 120 and the ground contact assemblies 124. In an exemplary embodiment, the base 126 of the header housing 117 includes signal contact openings 190 receiving corresponding header signal contacts 120 and ground contact openings 192 receiving corresponding header ground contacts 122. The header signal contacts 120 and the header ground contacts 122 may be held in the base 126 by an interference fit.

In an exemplary embodiment, the base 126 includes pockets 194 along the ground contact openings 192 that receive corresponding ground contact shield elements 300. The pockets 194 provide a space in the base 126 for the ground contact shield elements 300. Optionally, the spring beams 320 of the ground contact shield elements 300 may be deflectable in the pockets 194. The header housing 117 includes locating walls 196 in the base 126 between the pockets 194 and the signal contact openings 190. The locating walls 196 provide electrical isolation between the ground contact shield elements 300 and the header signal contacts 120. Optionally, the ground contact shield elements 300 engage the locating walls 196 to locate the ground contact shield elements 300 relative to the header signal contacts 120. For example, the flexed sections 324 may engage the locating walls 196. The locating walls 196 may position the flexed sections 324 by stopping the flexed sections 324 from expanding closer to the header signal contacts 120. As shown in FIG. 5, the spring beams 320 may be preloaded against the interior surface 308 of the header ground contacts 122 and the locating wall 196. For example, the ground contact shield element 300 may be pressed against the interior surface 308 at the distal end 322 and, at the base 310, may be pressed against the locating wall 196.

Figure 9:
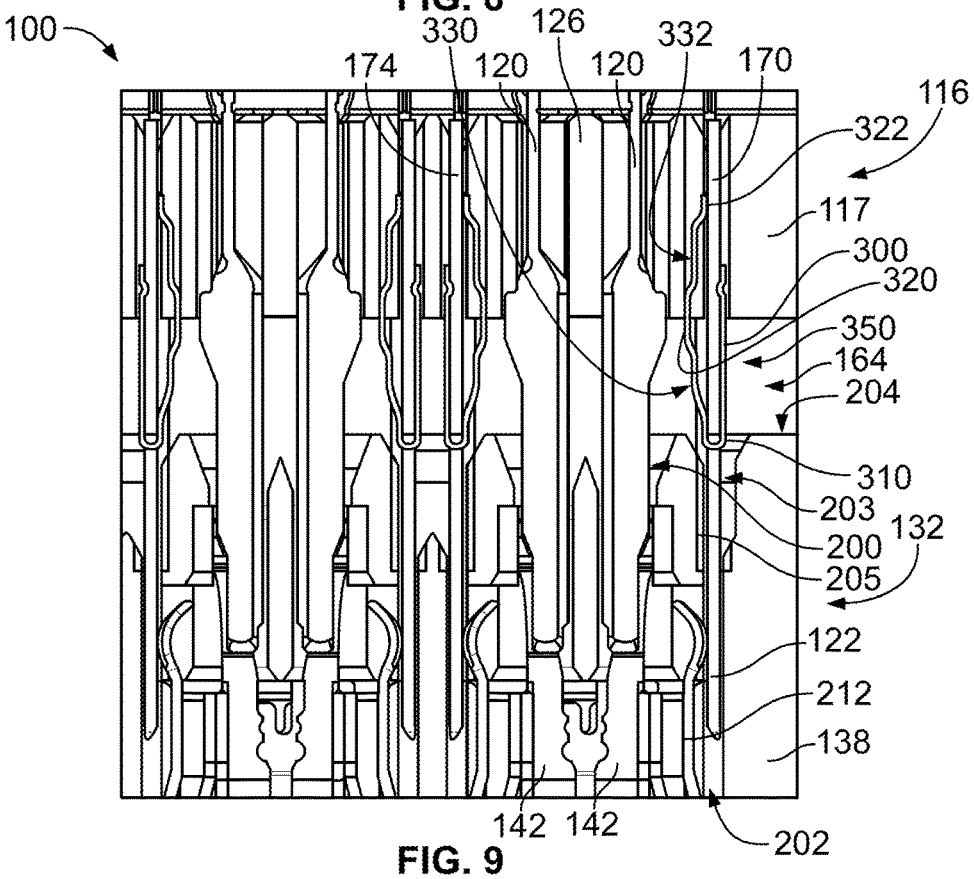
FIG. 9 is a cross-sectional view of a portion of the communication system showing a portion of the header connector partially mated with a portion of the receptacle connector.

FIG. 8 is a cross-sectional view of a portion of the communication system 100 showing a portion of the header connector 116 fully mated with a portion of the receptacle connector 132. FIG. 9 is a cross-sectional view of a portion of the communication system 100 showing a portion of the header connector 116 partially mated with a portion of the receptacle connector 132. FIG. 9 shows the header connector 116 partially de-mated from the receptacle connector 132 in a de-mated position. In an exemplary embodiment, the communication system 100 is designed to operate normally in the de-mated position. For example, the header connector 116 and the receptacle connector 132 have a mating tolerance or range within which the signal contacts are electrically connected. The mating tolerance may be approximately 1.5 mm or more. The header signal contacts 120 have a mating range or contact wipe with the receptacle signal contacts 142 within the mating tolerance. Similarly, the header ground contacts 122 have a mating range or contact wipe with the receptacle ground shields 212 within the mating tolerance.

During mating, the receptacle connector 132 is received in the cavity 164 of the header connector 116. The header signal contacts 120 are inserted into the contact channels 200 in the receptacle connector 132 for mating with the receptacle signal contacts 142. Similarly, the header ground contacts 122 are inserted into corresponding channels 202 in the receptacle connector 132 for mating with receptacle ground shields 212.

When fully mated, the mating end 204 of the receptacle housing 138 abuts against the base 126 of the header housing 117. As such, the header signal contacts 120 are surrounded by the plastic material of the header housing 117 and the receptacle housing 138. However, when partially mated in the de-mated position (FIG. 9), an air gap 350 is formed between the mating end 204 of the receptacle housing 138 and the base 126. Portions of the header signal contacts 120 are surrounded by air in the air gap 350. Because air has a different dielectric constant than the dielectric material of the header housing 117 and the receptacle housing 138, the impedance along the signal lines defined by the header signal contacts 120 may be affected.

The ground contact shield elements 300 are coupled to the header ground contacts 122 proximate to the base 126. The ground contact shield elements 300 are deflectable and spring biased to extend toward the nearest header signal contact 120 of the corresponding contact pair 121 such that the ground contact shield element 300 is positioned closer to the header signal contact 120 than the side wall 170, 174 of the corresponding header ground contact 122. For example, the spring beam 320 extends from the side wall 170, 174 toward the header signal contact 120 of the corresponding contact pair 121. The spring beam 320 is closer to the header signal contact 120 in the extended position (FIG. 9) and further from the header signal contact 120 in the flexed position (FIG. 8). The spring beam 320 is deflectable between the base 310 and the distal end 322 to change the relative spacing between the grounded ground contact shield element 300 and the header signal contact 120 to affect the impedance and improve the signal integrity and performance. In an exemplary embodiment, the ground contact shield element 300 is coupled to the header ground contact 122 such that a front portion 330 of the ground contact shield element 300 extends into the cavity 164 and a rear portion 332 of the ground contact shield element 300 extends into the base 126.

In an exemplary embodiment, the spring beam 320 is positioned in the cavity 164 to engage the receptacle connector 132 in the cavity 164. For example, the front portion 330 is positioned to engage the receptacle connector 132 when the receptacle connector 132 is mated with the header connector 116. For example, when fully mated, the receptacle connector 132 deflects the spring beam 320. In the partially mated position, the receptacle connector 132 may not engage the spring beam 320. However, as the receptacle connector 132 is moved toward the fully mated position, the receptacle connector 132 eventually engages the spring beam 320 to deflect the spring beam 320. The receptacle connector 132 moves the spring beam 320 from the extended position (FIG. 9) to the flexed position (FIG. 8). For example, the spring beams 320 may be received in the ground contact channels 202.

Optionally, the receptacle housing 138 includes pockets 203 associated with the ground contact channels 202 that receive the ground contact shield elements 300 during mating. Deflecting walls 205 of the receptacle housing 138 are configured to engage the spring beams 320 to deflect the spring beams 320. In the fully closed position, the deflecting walls 205 may hold the spring beams 320 against the interior surface 308. The receptacle housing 138 moves the spring beams 320 away from the header signal contacts 120 provide additional spacing between the metal of the ground contact shield elements 300 and the metal of the header signal contacts 120, which affects the impedance. However, the space between the ground contact shield elements 300 and the header signal contacts 120 is filled with the plastic material of the receptacle housing 138 and the header housing 117.

Figure 10:
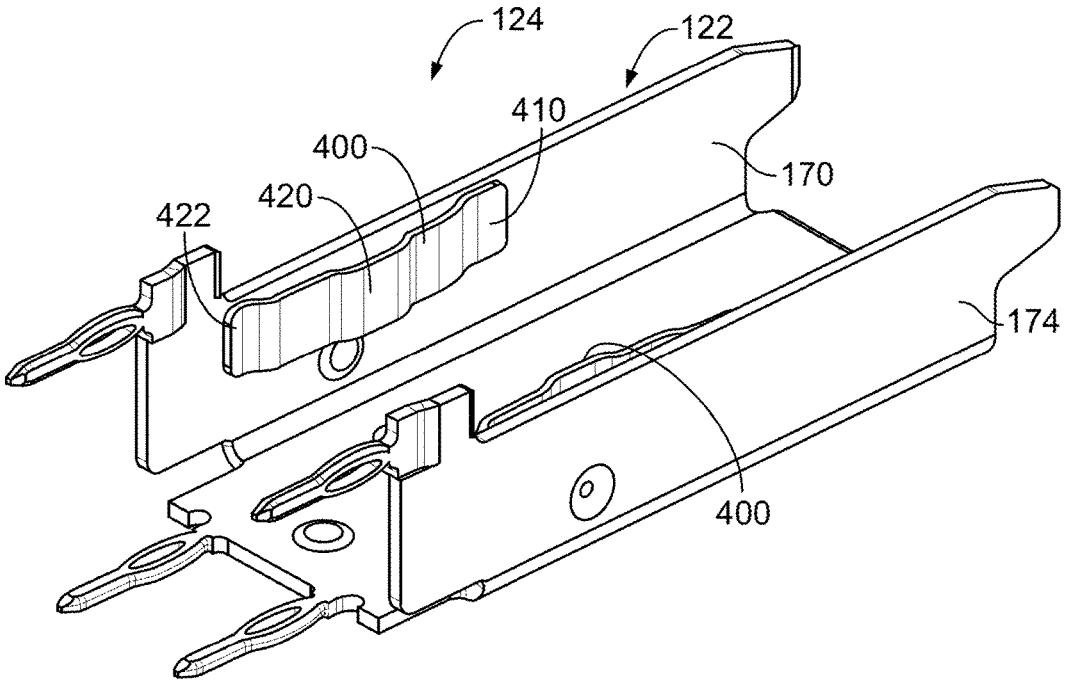
FIG. 10 is a perspective view of a ground contact assembly including a header ground contact and ground contact shield elements in accordance with an exemplary embodiment.

FIG. 10 is a perspective view of the ground contact assembly 124 including the header ground contact 122 and ground contact shield elements 400 in accordance with an exemplary embodiment. The ground contact shield elements 400 are similar to the ground contact shield elements 300; however, the ground contact shield elements 400 are welded to the side walls 170, 174 rather than being clipped to the side walls 170, 174. For example, a base 410 of the ground contact shield element 400 is welded to the corresponding side wall 170, 174 at a first point of contact and/or a distal end 422 of the ground contact shield element 400 is welded to the corresponding side wall 170, 174 at a second pint of contact. A spring beam 420 of the ground contact shield element 400 is flexible between the base 410 and the distal end 422.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A header connector comprising:

a header housing configured to engage a receptacle connector, the header housing having a base and a cavity forward of the base;

header signal contacts coupled to the base, each of the header signal contacts having a mating end extending into the cavity configured to be electrically connected to a corresponding receptacle signal contact, the header signal contacts being arranged in contact pairs;

header ground contacts coupled to the base, each of the header ground contacts having a mating end extending into the cavity, the header ground contacts providing electrical shielding for corresponding contact pairs of the header signal contacts, each header ground contact including an end wall and a side wall extending from the end wall; and ground contact shield elements coupled to corresponding header ground contacts along the corresponding side walls of the header ground contacts, the ground contact shield elements being deflectable and being spring biased to extend toward the nearest header signal contact of the corresponding contact pair such that the ground contact shield element is positioned closer to the header signal contact than the side wall of the corresponding header ground contact.

2. The header connector of claim 1, wherein the ground contact shield element is clipped to the side wall of the corresponding header ground contact.

3. The header connector of claim 1, wherein the ground contact shield element includes a spring beam extending from the side wall of the corresponding header ground contact toward the header signal contact of the corresponding contact pair.

4. The header connector of claim 1, wherein the ground contact shield element includes a base mounted to the side wall of the corresponding header ground contact and a spring beam extending from the base toward the header signal contact of the corresponding contact pair.

5. The header connector of claim 1, wherein the ground contact shield element includes a base mounted to the side wall of the corresponding header ground contact at a first point of contact with the header ground contact and a spring beam extending from the base to a distal end, the distal end engaging the side wall remote from the base at a second point of contact with the header ground contact, the spring beam being deflectable between the base and the distal end.

6. The header connector of claim 1, wherein the header ground contact includes an interior surface and an exterior surface with a slot therebetween, the ground contact shield element received in the slot and extending along the interior surface, the ground contact shield element being deflectable toward the interior surface.

7. The header connector of claim 1, wherein the side wall is a first side wall, the header ground contact including a second side wall extending from the end wall, the end wall, the first side wall and the second side wall having a C-shape providing electrical shielding on three sides of the corresponding contact pair.

8. The header connector of claim 7, wherein the ground contact shield element is a first ground contact shield element, the header connector further comprising a second ground contact shield element coupled to the second side wall.

9. The header connector of claim 1, wherein the ground contact shield element is deflectable toward the side wall.

10. The header connector of claim 1, wherein the ground contact shield element is coupled to the header ground contact such that a front portion of the ground contact shield element extends into the cavity and a rear portion of the ground contact shield element extends into the base.

11. The header connector of claim 1, wherein the ground contact shield element includes a spring beam being deflectable between an extended position and a flexed position, the spring beam being closer to the header signal contact of the corresponding pair in the extended position, the spring beam being positioned in the cavity to engage the receptacle connector in the cavity such that the receptacle connector moves the spring beam from the extended position to the flexed position.

12. The header connector of claim 1, wherein the ground contact shield element includes a spring beam extending from the base into the cavity to engage the receptacle connector in the cavity.

13. The header connector of claim 1, wherein the header housing includes locating walls in the base, the ground contact shield elements engaging the locating walls to locate the ground contact shield elements relative to the header signal contacts.

14. The header connector of claim 1, wherein the ground contact shield elements are secured to the corresponding header ground contacts by an interference fit.

15. The header connector of claim 1, wherein the ground contact shield elements are welded to the corresponding header ground contacts.

16. The header connector of claim 1, wherein the ground contact shield elements have multiple points of contact with the corresponding header ground contacts.

17. A communication system comprising:

a receptacle connector comprising a receptacle housing having a mating end, the receptacle connector comprising receptacle signal contacts and receptacle ground contacts held in the receptacle housing; and a header connector configured to be coupled to the receptacle connector, the header connector comprising:

a header housing having a base and a cavity forward of the base receiving the mating end of the receptacle housing;

header signal contacts coupled to the base, each of the header signal contacts having a mating end extending into the cavity, the mating end being received in the receptacle housing to be electrically connected to the corresponding receptacle signal contact, the header signal contacts being arranged in contact pairs;

header ground contacts coupled to the base, each of the header ground contacts having a mating end extending into the cavity, the mating end being received in the receptacle housing to be electrically connected to the corresponding receptacle ground contact, the header ground contacts providing electrical shielding for corresponding contact pairs of the header signal contacts, each header ground contact including an end wall and a side wall extending from the end wall; and ground contact shield elements coupled to corresponding header ground contacts along the corresponding side walls of the header ground contacts, the ground contact shield elements being deflectable and being spring biased to extend toward the nearest header signal contact of the corresponding contact pair such that the ground contact shield element is positioned closer to the header signal contact than the side wall of the corresponding header ground contact.

18. The communication system of claim 17, wherein the mating end of the receptacle housing is configured receded against the base of the header housing when the receptacle connector is fully mated with the header connector, a gap being defined between the mating end of the receptacle housing and the base of the header housing when the receptacle connector is partially mated with the header connector, the ground contact shield elements being positioned in the gap.

19. The communication system of claim 17, wherein the ground contact shield elements are positioned in the cavity forward of the base and extend into the base, the mating end of the receptacle housing configured to engage the ground contact shield elements in the cavity when the receptacle connector is mated with the header connector.

20. The communication system of claim 17, wherein the ground contact shield elements include spring beams, the spring beams being deflectable toward the corresponding header ground contacts, the receptacle housing engaging the spring beams to deflect the spring beams toward the corresponding header ground contact.

21. A ground contact assembly comprising:

a header ground contact having a mating end, each header ground contact including an end wall and a side wall extending from the end wall defining a shield pocket configured to receive at least one header signal contact; and a ground contact shield element coupled to the header ground contact along the side wall of the header ground contact, the ground contact shield element being deflectable and being spring biased to extend into the shield pocket away from the side wall such that the ground contact shield element is positioned closer to the header signal contact than the side wall of the corresponding header ground contact.

22. The ground contact assembly of claim 21, wherein the ground contact shield element includes a base mounted to the side wall and a spring beam extending from the base toward the header signal contact.

23. The ground contact assembly of claim 21, wherein the ground contact shield element includes a base mounted to the side wall at a first point of contact with the header ground contact and a spring beam extending from the base to a distal end, the distal end engaging the side wall remote from the base at a second point of contact with the header ground contact, the spring beam being deflectable between the base and the distal end.

24. The ground contact assembly of claim 21, wherein the header ground contact includes an interior surface and an exterior surface with a slot therebetween, the ground contact shield element received in the slot and extending along the interior surface, the ground contact shield element being deflectable toward the interior surface.

25. The ground contact assembly of claim 21, wherein the side wall is a first side wall, the header ground contact including a second side wall extending from the end wall, the end wall, the first side wall and the second side wall having a C-shape providing electrical shielding on three sides of the shield pocket.

26. The ground contact assembly of claim 21, wherein the ground contact shield element is a first ground contact shield element, the ground contact assembly further comprising a second ground contact shield element coupled to the second side wall.

* * * * *